US007966697B2

(12) United States Patent
Springer

(10) Patent No.: US 7,966,697 B2
(45) Date of Patent: Jun. 28, 2011

(54) HINGES

(76) Inventor: Kenneth Springer, Reading (GB)

( * ) Notice: Subject to any disclaimer, the term of this patent is extended or adjusted under 35 U.S.C. 154(b) by 309 days.

(21) Appl. No.: 11/571,952

(22) PCT Filed: Jul. 15, 2005

(86) PCT No.: PCT/GB2005/002782

§ 371 (c)(1),
(2), (4) Date: Oct. 15, 2008

(87) PCT Pub. No.: WO2006/008487

PCT Pub. Date: Jan. 26, 2006

(65) Prior Publication Data

US 2009/0217485 A1 Sep. 3, 2009

(30) Foreign Application Priority Data

Jul. 17, 2004 (GB) ..... 0416060.2
Sep. 22, 2004 (GB) ..... 0420998.7

(51) Int. Cl.
*E05F 1/08* (2006.01)

(52) U.S. Cl. ..... 16/304; 16/332; 16/328; 16/345; 16/374; 16/376

(58) Field of Classification Search ..... 016/304, 016/303, 331, 332, 334, 387, 326, 363, 374, 016/376, 377, 265, 266, 328, 345, 347; 482/140, 482/142, 148, 124, 126
See application file for complete search history.

(56) References Cited

U.S. PATENT DOCUMENTS 44,076 A * 9/1864 Colburn ..... 16/377
145,315 A * 12/1873 Thomas ..... 16/377
294,746 A * 3/1884 Straup et al. ..... 16/330
1,076,568 A 10/1913 Furuya
1,336,430 A * 4/1920 Gustafson ..... 292/63
1,508,013 A * 9/1924 De Waters ..... 16/351
(Continued)

FOREIGN PATENT DOCUMENTS

DE 199 46 138 A1 4/2001
(Continued)

OTHER PUBLICATIONS

Search Report for EPA 05758149.8 citing above references, completed Jun. 10, 2010.

*Primary Examiner* — Chuck Y. Mah
(74) *Attorney, Agent, or Firm* — Robert W. J. Usher

(57) ABSTRACT

A hinge has two leaves (11"), (13") connected by a hinge pin (42") retained in alternate sleeves (17"), (19") on the facing edges of the two leaves, with limited axial movement of the hinge leaves relative to one another along the pin. A spring (46") biases the leaves towards one end of this movement, where sleeves (19") on one leaf (13") have slots (74, 84) at one axial end and sleeves (17") are axially preceded by flanges (76) which, according to the angular opening of the hinge, either abut the ends of the respective sleeves (19") or enter one or other of the slots (74, 84). When the flange (76) abuts the sleeve end, the hinge is free to rotate, but when the hinge reaches an opening angle at which spring pressure causes the flange (76) to enter one or other of the slots, the hinge is locked. It can be released by manually sliding the locked sleeves (17"), (19") apart against the spring pressure.

19 Claims, 10 Drawing Sheets

U.S. PATENT DOCUMENTS 2,811,741 A * 11/1957 Miller et al. ..... 16/376
3,431,591 A * 3/1969 Betso ..... 16/265
3,874,029 A * 4/1975 McCullough ..... 16/329
4,483,028 A * 11/1984 Payne ..... 5/426
4,594,750 A * 6/1986 Carcas ..... 16/229
4,603,452 A * 8/1986 Paciorek ..... 16/262
4,611,805 A 9/1986 Franklin et al.
4,845,809 A 7/1989 Pillifant et al.
5,287,596 A * 2/1994 Chen et al. ..... 16/331
6,353,967 B1 3/2002 Escobar

FOREIGN PATENT DOCUMENTS

GB 2 190 952 A 12/1987

* cited by examiner

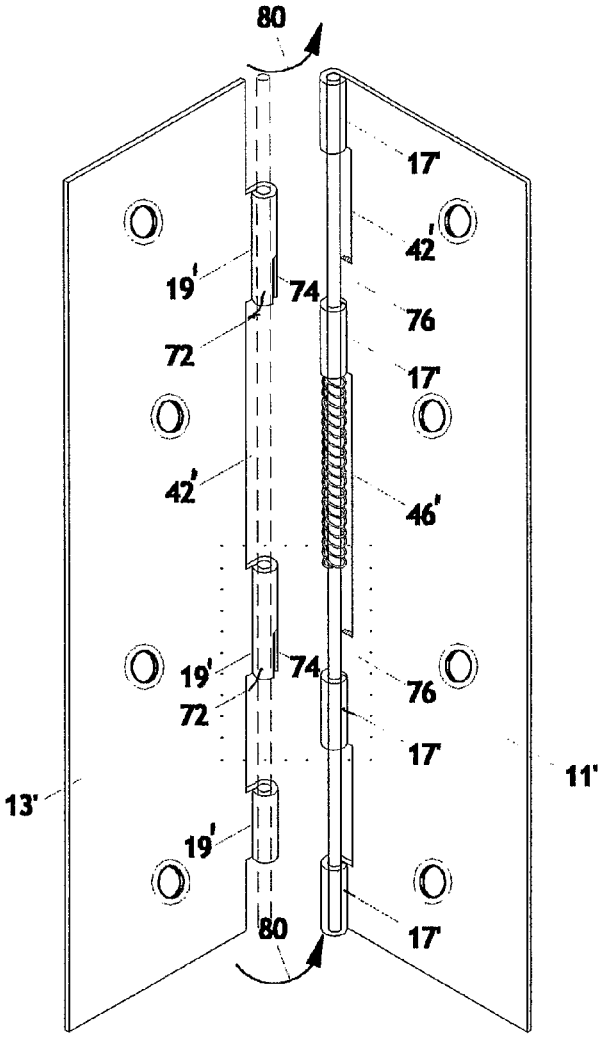
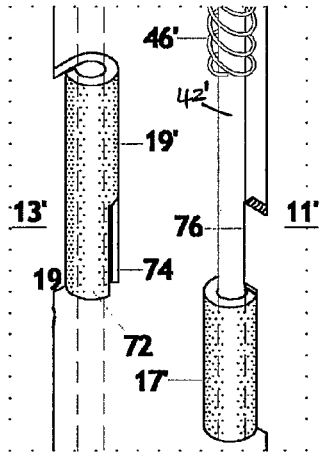
Figure 18
Figure 17

HINGES

The present invention relates to improvements in or relating to hinges, and especially to a hinge with limited movement, which may be useful in many applications in relation to machinery and in industry, as well as being suitable for use in furniture and household articles, and in a specific application to assist in anchoring equipment under the bottom of a door, fence, or other item having a separation from the ground. The present invention also relates to equipment to be so anchored.

Many pieces of furniture, such as cupboards, display cabinets and sideboards, have hinged panels such as doors which are preferably held closed until opening is required. The prior art shows the use of locks and catches to achieve such a condition. The present invention seeks to provide a means whereby locks and catches can be eliminated and yet the same conditions of use can be applied.

Many cupboards, desks and sideboards have hinged panels or doors which, although not requiring to be locked, are desirably maintained in a closed position and also resistant to opening by children and pets. The present invention seeks to provide a hinge which is resistant to casual and accidental opening and necessitates a deliberate act to open a door.

It is also desirable that a door, in certain applications, should be openable only to a predetermined extent. The prior art has offered fixed and movable doorstops and extending unfolding arms of limited travel to limit the extent of opening of a door. The present invention seeks to provide a hinge where the extent of opening of a door can be selectably limited without use of such devices.

Often it is desirable to be able to open a door to limited and fixed extent, the door being lockable at that degree of opening. For example, in a chest or casket it may be desired that the door be retained in a closed condition, a first open condition where the door is hinged up to 90° and held in that position, and a second open condition where the door may be swung to any angle physically possible so that the chest or casket may be fully opened. The present invention seeks to provide a hinge where such elaborate behaviour is made possible.

It is known to anchor apparatus to the ground. A typical, though non-exclusive, example of such apparatus is exercise apparatus. Other such apparatus can include signs, posts, plant supports and many other items where anchorage to the ground is desirable or essential. Often it is not possible to obtain anchorage to the ground. A near substitute is to anchor the equipment beneath a closed door, bar or fence. The door, bar or fence being affixed relative to the ground, and the anchorage being affixed beneath the door, bar or fence, the apparatus so anchored may be sufficiently secured. The example given in this patent specification relates to exercise apparatus for fixing beneath a door. It is to be realised that the invention is not so limited.

Whilst it is known to use a bracket slidable beneath an open door to support equipment held to the ground beneath the open door when the door is closed, means whereby equipment may be releasably attached beneath a closed door or a locked door are not so readily available. The present invention seeks to provide means whereby equipment may be attached beneath a locked door. Equally, the present invention seeks to provide releasable attachment beneath a fence, which is possible without access to both sides of the fence or without partially removing the fence.

According to a first aspect, the present invention provides a hinge comprising: a first leaf; a second leaf; and pin means defining an axis of rotation of the first leaf about the second leaf; said first leaf comprising a first position-defining flange, said second leaf comprising a second position-defining flange; and said first position-defining flange and said second position-defining flange engaging one another to limit the rotation of the first leaf relative to the second leaf about said pin means beyond a predetermined angle. Each leaf may be a substantially planar portion of the hinge.

According to a second aspect, the invention provides a hinge comprising: a first leaf; a second leaf; pin means defining an axis of rotation, which pin means are engaged with each leaf, and at least one of said leaves being slidable axially along the pin means relative to the other said leaf; spring means adapted to bias the respective leaves axially from a first axial position relative to one another on the pin means into a second axial position relative to one another on the pin means; and abutment means on each said leaf; wherein the said abutment means are so located and dimensioned that, when the leaves are in the second axial position, rotational movement of the leaves with respect to one another is limited at a stop formed by the mutual abutment of the abutment means, and when the leaves are in the first axial position, rotational movement of the leaves with respect to one another is not so limited at such stop.

Thus articulation of the hinge is limited by abutment means forming a stop in the normal second axial position into which the hinge leaves are biased by the spring means, but by moving the leaves apart along the pin means against the spring to the first axial position, the hinge can be moved beyond the stop.

The abutment means may comprise flanges formed in the hinge leaves as axial extensions to the sleeves for the pin means, extending towards the adjacent sleeve of the opposite leaf, such that the respective flanges may or may not overlap according to the axial positions of the leaves relative to one another. Such flanges may appear as partially open sleeves. The alternate sleeves are the knuckles of the hinge, and the abutment means are desirably operative between the adjacent sleeves or knuckles of the respective hinge leaves.

According to numerous preferred features of this a second aspect, the present invention provides a bistable bracket comprising the aforesaid hinge wherein each leaf has, or is attached to, a respective substantially planar portion; said hinge comprising a pin defining an axis of rotation; the first leaf or planar portion having one or more first axial position-defining flanges and two or more first pin-retaining sleeves or channels; the second leaf or planar portion having one or more second axial position-defining flanges and two or more second pin-retaining sleeves or channels; and said spring means providing force along the axis to urge the first and second leaves in a biased axial direction relative to one another; where said first substantially planar portion and said second substantially planar portion are supported by said hinge to rotate about said axis with respect to one another; said first substantially planar portion being rotatable with respect to said second substantially planar portion in a first rotational direction, when urged against the biased axial direction to stress and preferably to compress said spring, to a first angular position to adopt a first axially stable position, where the first and second portions of the bracket are substantially coplanar and said first position-defining flanges are urged into axial abutment with said second position-defining flanges by said spring; and where said second planar portion is rotatable about said axis from said first angular position, in a second rotational direction contrary to said first rotational direction, to a second angular position where said first and second position-defining flanges disengage in the axial direction and said first and second leaves are urged by the spring in the biased axial direction for said second position-defining flanges to axially abut said pin-retaining sleeves or channels in a second axially stable position and for first and second position-defining flanges to mutually abut in said first rotational direction to prevent rotation of said first and second substantially planar portions in said first rotational direction beyond a predetermined angle.

It will be understood that the term "pin" is not limited to a single continuous rod, bar or wire, but includes equivalent structures which may be discontinuous and may be formed of the material of one of the leaves of the hinge, and enable leaves to turn and to move relatively axially. References to a substantially planar portion which a hinge leaf may have, or be attached to, relate to a substantially flat extension of a hinge leaf beyond the hinge region, or to a flat panel or the like to which the hinge leaf is attached.

According to a third aspect of the invention, an exercise device, and preferably a sit-up anchor, comprises a bistable bracket of the kind set out herein.

The invention preferably provides that the spring is helical, and that the spring is provided around said pin between a pin-retaining sleeve or channel on the first leaf and a pin-retaining sleeve or channel on the second leaf. Other spring means may be used according to their suitability for the particular hinge structure chosen in any instance.

The invention further includes an operating rod, operable to urge apart said position-defining flanges and said pin-retaining sleeves and to urge said second side to cause said first and second portion to adopt said first stable position. Preferably, the operating rod is operable to urge apart said pin-retaining sleeves to trigger movement between said first stable position and said second stable position.

The present invention preferably further provides that the first substantially planar portion and the second substantially planar portion are movable relative to one another along the axis of the pin means, said first substantially planar portion comprising a first axial position-defining flange; said second substantially planar portion comprising a second axial position-defining flange; said first substantially planar portion comprising a first rotational position-defining flange; said second substantially planar portion comprising a second rotational position-defining flange; and comprises means to urge the first substantially planar portion in an axial direction towards the second substantially planar portion; where the first substantially planar portion is foldable against the second substantially planar portion and urgeable by the urging means to move relative thereto in the axial direction for said first rotational position-defining flange and said second rotational position-defining flange to engage to maintain the first substantially planar portion and the second substantially planar portion within a selectable range of rotational angles beyond overlying and closed against one another; and where said first substantially planar portion is movable in the axial direction relative to the second substantially planar portion for the first rotational angle defining flange to disengage the second rotational angle defining flange to allow free rotation of said first substantially planar portion about said axis relative to said second substantially planar portion and to be so maintained by said first axial position-defining flange being operable to engage the second axial position-defining flange when said rotational angle is greater than the selectable angle.

The present invention also provides that the selectable angle can be zero degrees such that the first substantially planar portion can be locked in a parallel position closed against the second substantially planar portion.

The present invention also provides that locating slots can be provided to provide one or more releasably lockable rotational positions for the first substantially planar portion and the second substantially planar portion.

The present invention also provides that the urging means can be a spring, and that the spring can be helically wound around the pin.

The invention is further described, by way of example, by the following description to be read in conjunction with the appended drawings in which:

FIG. 17 is a projected slightly expanded view of the hinge of FIG. 16 showing how the portions of the third embodiment hinge, which is selectably lockable in a closed position or released to a rotatable position, are disposed;

FIG. 18 is a detailed view of the enclosed section of FIG. 17;

and

Figure 20:
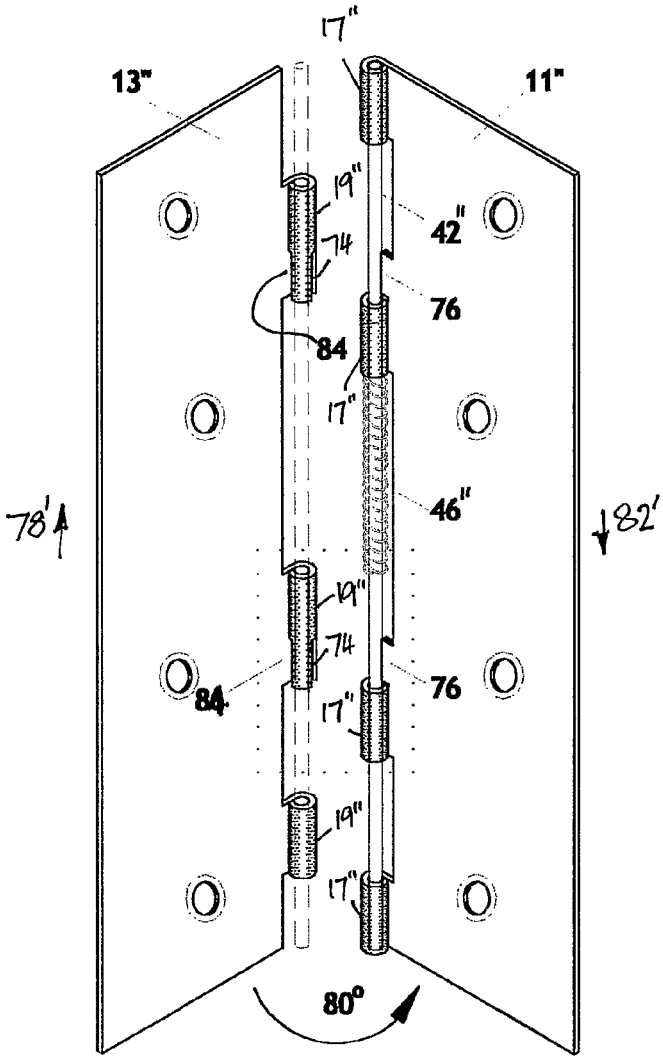
FIG. 20 is a projected view of the portions of FIG. 19, slightly expanded, to show their disposition.
Figure 21:
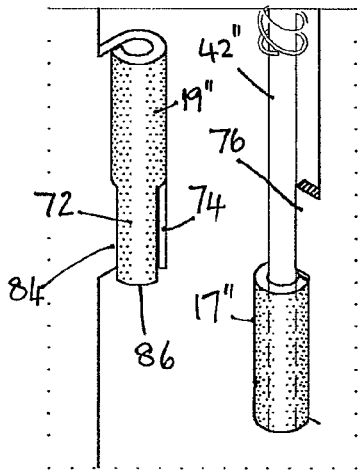

FIG. 21 is a detailed view of the enclosed section of FIG. 20.

Figure 1:
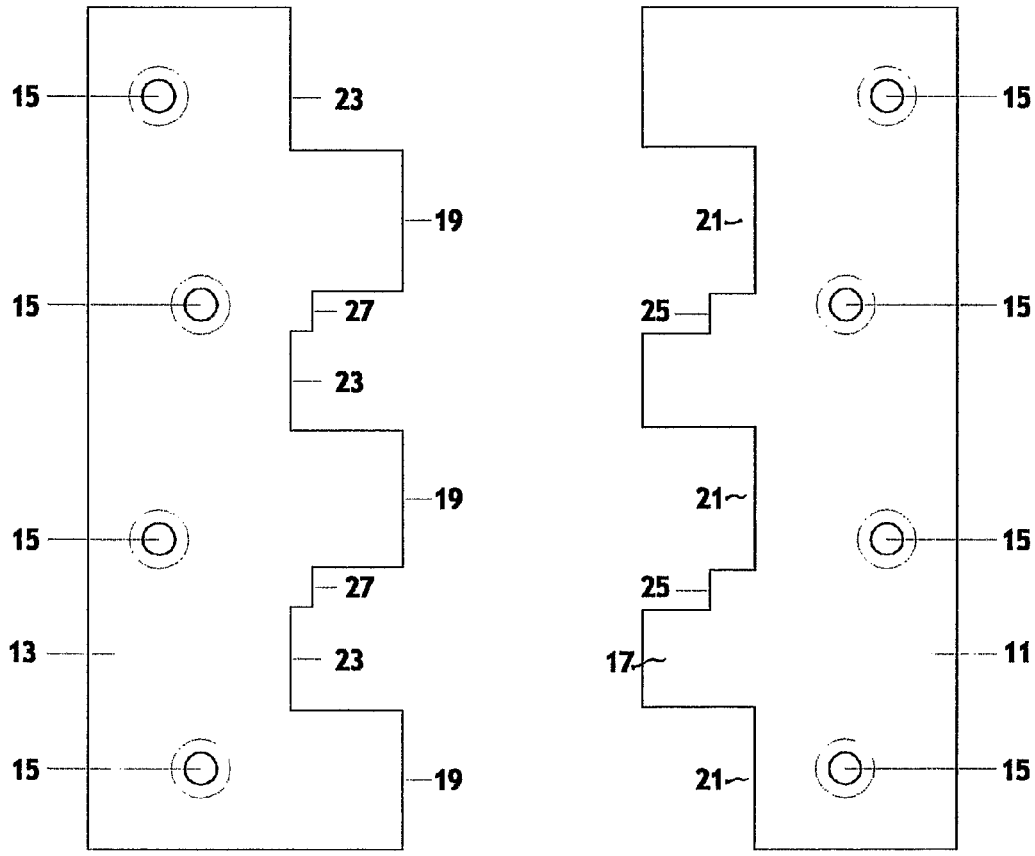
FIG. 1 is a plan view of the flat metal stampings from which the first and second portions of a first embodiment of a hinge are formed.
Figure 2:
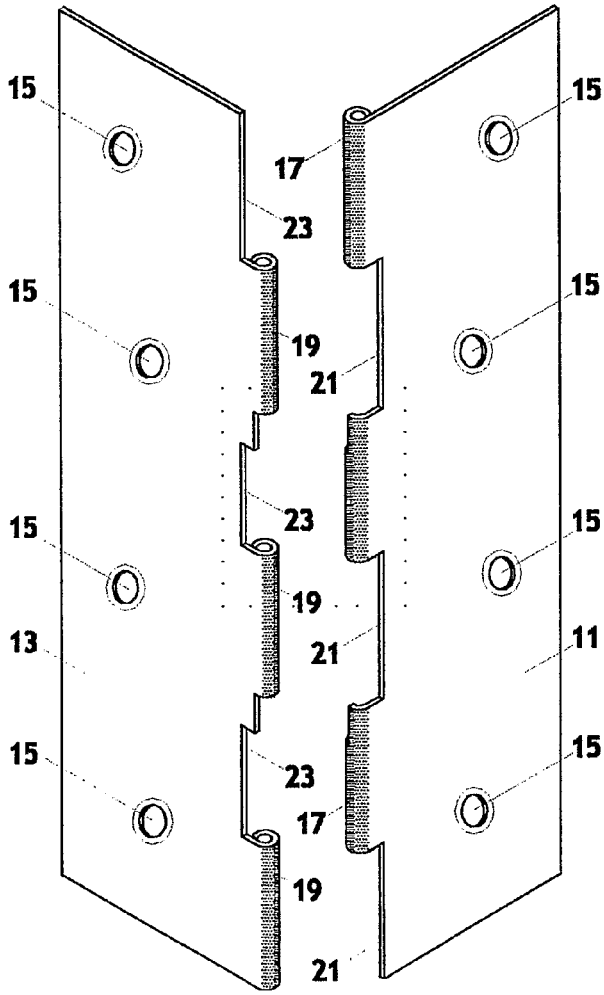
FIG. 2 is an isometric projected view of the portions of FIG. 1 formed into shape to fit about a hinge pin (not shown), and slightly exploded to make clear the details.
Figure 3:
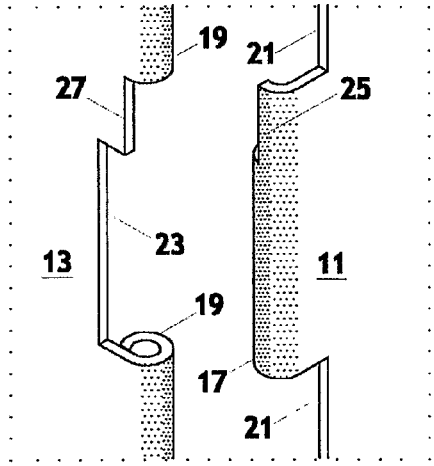
FIG. 3 is a magnified detail of the boxed portion of FIG. 2.

Attention is first drawn to FIGS. 1, 2, and 3 showing a first embodiment of a hinge according to the present invention.

FIG. 1 shows a view of a first leaf on one side of the hinge 11 and a second leaf on the other side of the hinge 13 after the flat metal portions have been stamped to cut their outlines but before they have been formed to fit round a hinge pin (omitted in FIGS. 1, 2 and 3 for clarity). FIG. 2 shows the first side 11 and the second side 13 of a hinge after having been formed and in isometric projected view, the first side 11 being partially separated from the second side 13 to show more clearly the path taken by the hinge pin and the relationship between the various parts. FIG. 3 shows enlarged detail of the enclosed area of FIG. 2.

The first leaf or side of the hinge 11 and the second leaf or side of the hinge 13 are designed to close flat against each other. In FIG. 2 the two leaves 11, 13 are shown at what in this example is their furthest extent of opening, 90° to one another, having rotated about a hinge pin in a rotational direction. The first side of the hinge 11 and the second side of the hinge 13 are each designed to be screwed or otherwise affixed to a door or a doorpost or other support member by means of screws or rivets inserted through fixing holes 15. The first side 11 of the hinge comprises three aligned and spaced apart first side pin retaining sleeves 17 and the second side 13 of the hinge comprises three aligned and spaced apart second side pin-retaining sleeves 19. The first side 11 of the hinge comprises first side voids 21 designed to accept the second side pin-retaining sleeves 19. The second side 13 of the hinge comprises second side voids 23 designed to accept the first side pin-retaining sleeves 17. The first side 11 of the hinge comprises first side flanges 25 designed to engage second side flanges 27 on the second side 13 of the hinge by abutment of their edges. When assembled (not shown) the sleeves 17, 19 are aligned in the opposing voids 23, 21 forming the knuckles of the hinge, and the pin passes through the aligned axial channels in each sleeve.

As shown more clearly in FIG. 2 and FIG. 3, the hinge can be fully shut with the first side 11 and the second side 13 plane parallel and overlying one another, corresponding to the door or other item supported by the hinge being completely closed. When opened, the first side 11 of the hinge can only rotate about the pin and the second side 13 of the hinge to the point where the edge of the first side flange 25 abuts the edge of the second side flange 27 and prohibits any further movement. The hinge detailed in FIG. 1, FIG. 2 and FIG. 3 thus limits the extent to which the supported door or other item can be opened. In the examples shown in FIG. 1, FIG. 2 and FIG. 3 the extent of opening is substantially 90°. It is to be appreciated that the extent of opening can be any angle, the exact angle being predetermined by selecting the extent in the rotational direction by which the first side flange 25 and the second side flange 27 extend around the pin, being wrapped in the same manner as the first side pin retaining channel 17 and the second side pin retaining channel 19. Apart from the side flanges and the channels, the leaves of the hinge are planar.

Figure 4:
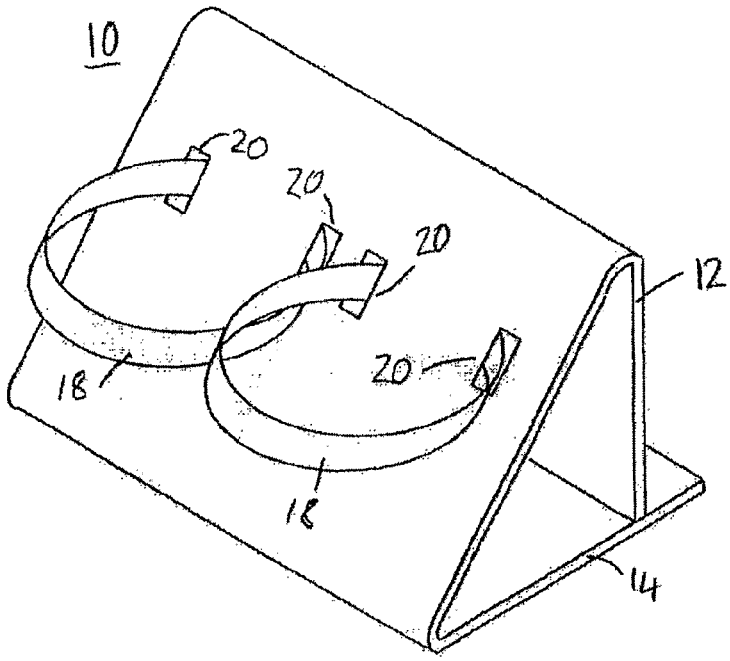
FIG. 4 shows an exemplary exercise device in the form of a sit-up anchor to be anchored beneath a door.

Attention is next drawn to FIG. 4 showing an isometric view of a second embodiment of the invention in the form of a sit-up exercise anchorage 10 comprising a substantially triangular frame 12 on a base 14 designed to be inserted beneath and held by a closed door 16 (FIGS. 5A to 5D). Retaining straps 18 are provided between horizontally separated aperture pairs 20 to accept the feet of an individual doing sit-up exercises and to stop the feet of the individual from rising into the air as the individual performs a sit-up. The sit-up anchorage 10 of FIG. 1 is just one example of exercise equipment and other equipment which may be anchored using the bistable spring bracket of the invention, to be described in relation to FIGS. 6 to 15.

Figure 5A:
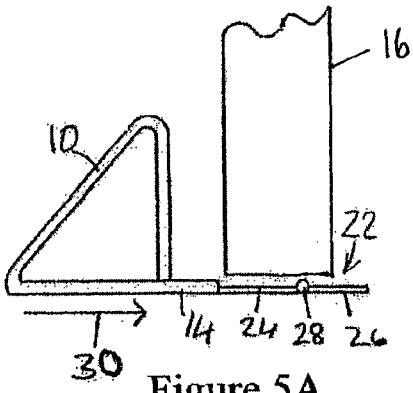
FIGS. 5A, 5B, 5C and 5D show the various stages in anchoring and releasing a bistable bracket in accordance with the invention to anchor and release the sit-up anchor of FIG. 4.

Attention is next drawn to FIG. 5A showing the bistable spring bracket 22 attached to the base 14 of the frame 12 by welding or other convenient means, and opened up into the first stable position where the bistable spring bracket 22 is substantially planar having a first portion 24 and a second portion 26 rotatable about a hinge pin 28. The bistable spring bracket 22 and a portion of the base 14 are inserted below the bottom of the door 16 as indicated by arrow 30.

Figure 5B:
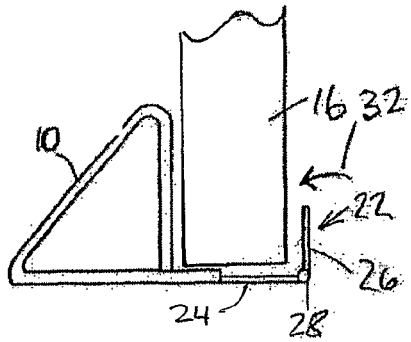

Attention is next drawn to FIG. 5B showing a second stage of insertion and operation of the bistable spring bracket below the door 16. The second portion of the bistable spring bracket 22 is rotated in the second rotational direction opposite to the first rotational direction, as indicated by arrow 34 to a second stable position where the second portion is locked against movement in the first rotational direction about hinge pin 28 beyond 90° thereby retaining the sit-up anchorage 10 beneath the door 16.

Figure 5C:
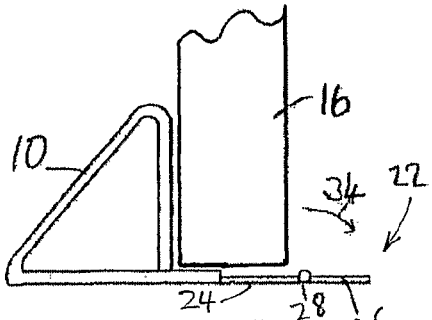

FIG. 5C shows a third stage in the operation of the bistable spring bracket 22. The second portion 26 of the bistable spring bracket 22 is rotated about the hinge 28 in the first rotational direction as indicated by arrow 34, back to the first stable position otherwise as illustrated in FIG. 5A. The second portion 26 is released from the locked second stable position of FIG. 5B by sliding the second portion 26 along the pin of the hinge 28 and then rotating it back to the first stable position. This action is further explained hereafter.

Figure 5D:
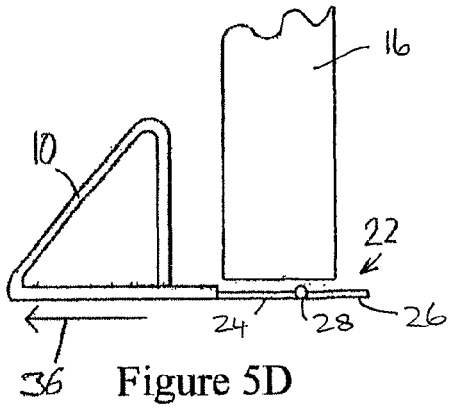

Attention is next drawn to FIG. 5D which shows how the sit-up anchorage 10 and the bistable spring bracket 22 may be slid out from under the door 16 as shown by arrow 36.

Figure 6:
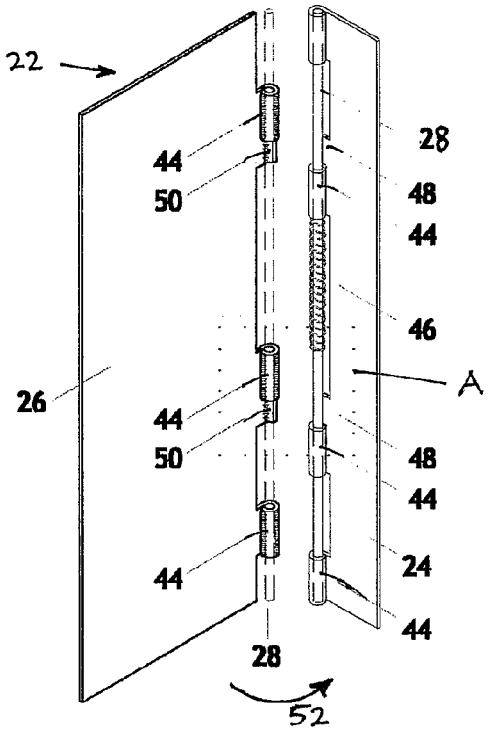
FIG. 6 shows an exploded view of the bracket used in FIGS. 5A to 5D illustrating portions of the hinge.

Attention is next drawn to FIG. 6 showing an exploded angle view of the bistable spring bracket 22 in the second stable position otherwise shown in FIG. 5B.

The first planar portion 24 is hinged to rotate about the second planar portion 26 to form two leaves of a hinge comprising pin 28, shown in phantom outline on the second portion 26. Each leaf comprises two or more pin retaining sleeves 44 for grasping the pin 28 and permitting rotation about the pin as axis. A spring 46 is wound about the pin 28 in a helical fashion and is positioned to sit on the pin between a pin-retaining sleeve 44 on the second portion 26 and a pin-retaining sleeve 44 on the first portion 24. The first portion 24 comprises first position-defining flanges 48. The second portion 26 comprises second position-defining flanges 50.

Figure 7:
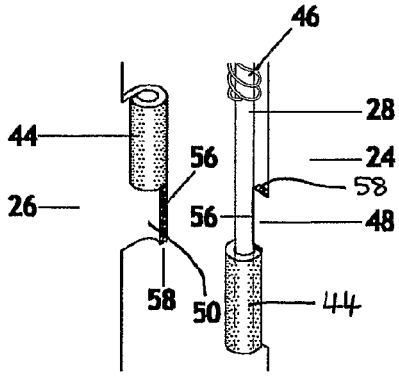
FIG. 7 shows detail of the dotted outline box A of FIG. 6.
Figure 11:
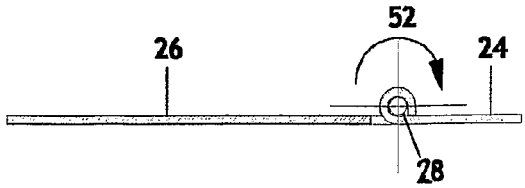
FIG. 11 is an end view of the bracket in the first stable position.

FIG. 7 shows detail of the outlined box A depicted in FIG. 6. Here it can be seen that the first portion position-defining flange 48 protrudes in the general direction of the pin 28 and the spring 46 presses against the visible pin-retaining sleeve 44 on the second portion 26. The second position-defining flange 50 on the second portion also protrudes towards and partially around the pin 28. When in the opening-limiting alignment of the hinge leaves shown in FIGS. 6 and 7, rotational edges 56 abut one another. When in the position shown in FIG. 5B longitudinal edges 58 abut one another. In this manner, the two stable positions are defined by the first position-defining flange 48 and the second position-defining flange 50.

Figure 8:
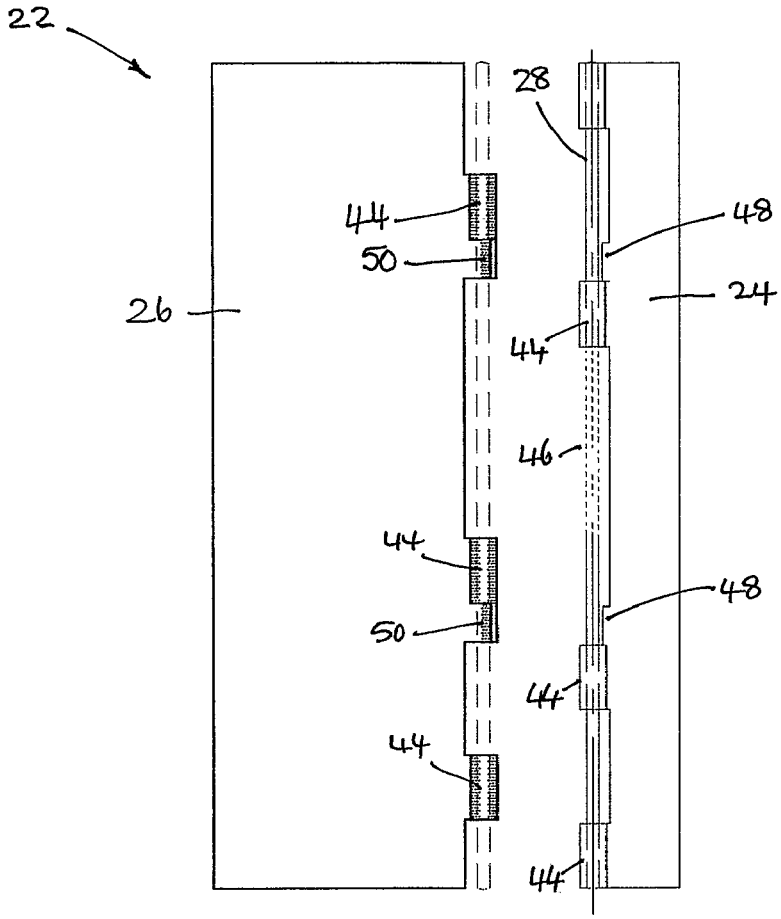
FIG. 8 shows a plan view of the exploded bracket otherwise shown in an angled view in FIG. 6.

FIG. 8 shows an exploded view of the bistable spring bracket 22 and shows more clearly the relationship between the first position-defining flanges 48 and the second position-defining flanges 50.

Figure 9:
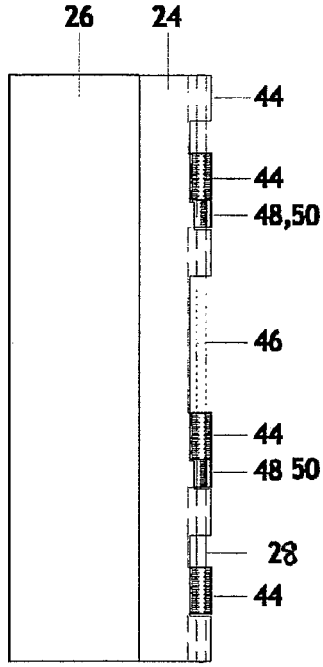
FIG. 9 shows the bracket in a fully closed position.

FIG. 9 shows a plan view of the assembled bistable sprung bracket of FIG. 6 in the completely closed position where the first portion 24 rests against the second portion 26, with the first portion 24 and the second portion 26 being in axial alignment along the pin 42 and the first position-defining flanges 48 and the second position-defining flanges 50 lying in overlapping positions along the pin 42 so that if the first portion 24 is opened against the second portion 26 the first position-defining flanges 48 abut against the second position-defining flanges 50 to limit the amount of rotation in the first direction (as indicated by arrow 52 in FIG. 6). The amount of rotation allowed in the first direction 52 can be pre-selected by the rotational extent of each of the first position-defining flange 48 and the second position-defining flange 50. While in the example given the angular rotation in the first direction 52 is shown to be substantially 90°, it is to be appreciated that any angle up to and exceeding 180° from the position shown in FIG. 9 can be selected by adjusting the stops determined by the dimensions of the flanges.

Figure 10:
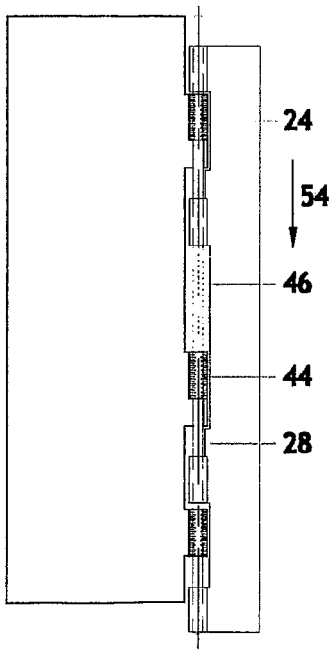
FIG. 10 shows the bracket in the first stable position with the first and second substantially planar portions in line.

Attention is next drawn to FIG. 10 showing how the first portion 24 and the second portion 26 can be moved beyond the locking point discussed in relation to FIG. 9 to a first stable position.

The first portion 24 is moved in a first axial direction as shown by arrow 54 so that the spring 46 becomes compressed between a pin-retaining sleeve 44 on the first portion 24 and a pin-retaining sleeve 44 on the second portion 26. The position adopted by the bistable spring bracket 22 on opening the hinge to 180° is shown in end view in FIG. 11.

When the first portion 24 has been moved as shown by arrow 54, the first position-defining flanges 48 and the second position-defining flanges 50 are moved out of abutment along the pin 42. This allows the first portion 24 and the second portion 26 to be moved free of any mechanical impediment in the first rotational direction 52 (from the position shown in FIG. 9). When mechanical force is released between the first portion 24 and the second portion 26 the spring 46 pushes the pin-retaining sleeve 44 from the first portion 24 and the pin-retaining sleeve 44 from second portion 26 until the first position-defining flanges 48 and the second position-defining flanges 50, which have now rotated relatively to one another sufficiently to overlap in an axial direction, to engage end to end in axial abutment. This allows the bistable spring bracket 22 to remain in the position shown in FIG. 10 and FIG. 11.

Figure 12:
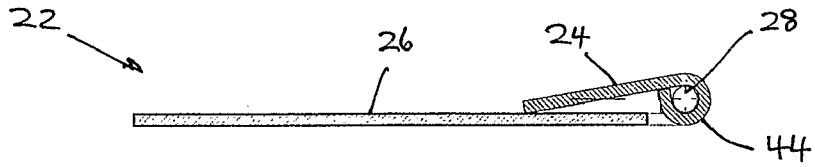
FIG. 12 is an end view of the bracket otherwise shown in FIG. 7.

FIG. 12 is an end view of the position of the bistable spring bracket 22 when in the position shown in FIG. 9.

Figure 13:
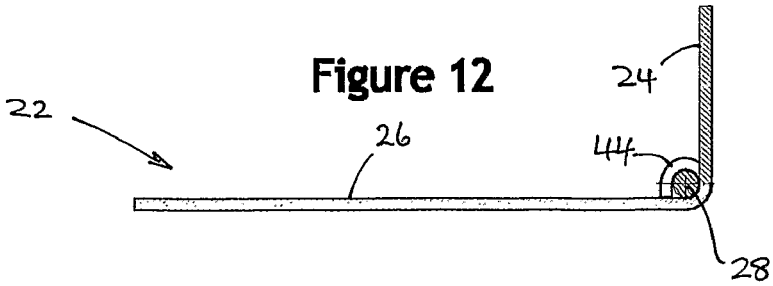
FIG. 13 is an end view of the bracket in the position where further rotation about the axis is prevented when the bracket is in the second stable position.

FIG. 13 shows the bistable spring bracket 22 of FIGS. 9 and 12 when it is opened to the point of rotation in the first rotational direction 52 where the rotational edges 56 of the first position-defining flanges 48 and the second position-defining flanges 50 engage, preventing any further rotation in the first rotational direction 52. As earlier explained, the actual extent of permitted rotation of the first portion 24 relative to the second portion 26 can be any value between 0 and 180° as defined by the circumferential extent of the first position-defining flange 48 and the second position-defining flange 50. The greater the rotational extent of each, the less the second portion 26 and the first portion 24 can be rotated in the first rotational direction 52 from the position shown in FIG. 12.

Figure 14:
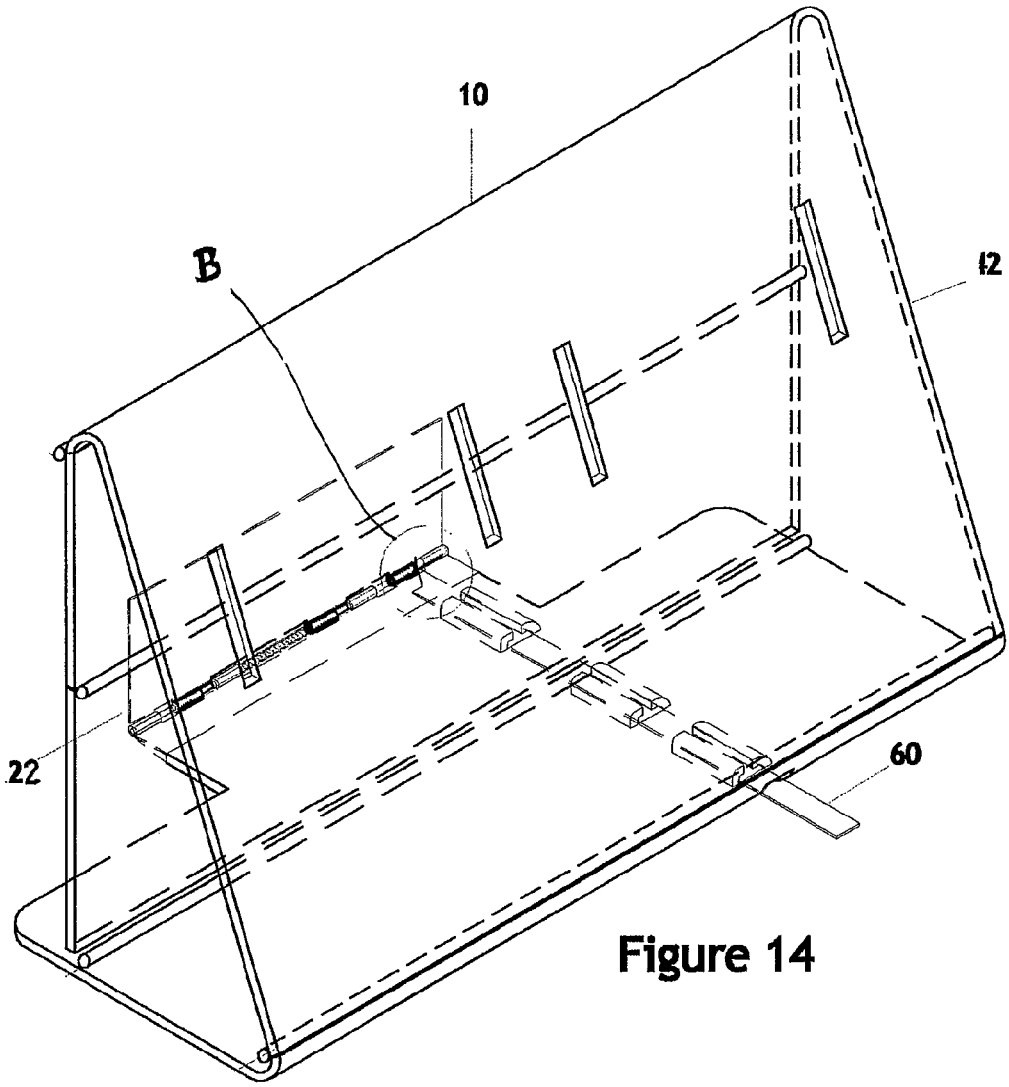
FIG. 14 is a skeletonised view of a sit-up anchor of the kind shown in FIG. 4 where an operating rod is provided to allow manipulation of the bracket beneath a locked door. Otherwise hidden portions are shown in dotted outline.

Attention is next drawn to FIG. 14 showing an isometric skeletonised view of a sit-up anchorage 10 where an operating rod 60 is provided on the base 14 of the sit-up anchorage 10 to operate the bistable spring bracket 22.

Figure 15:
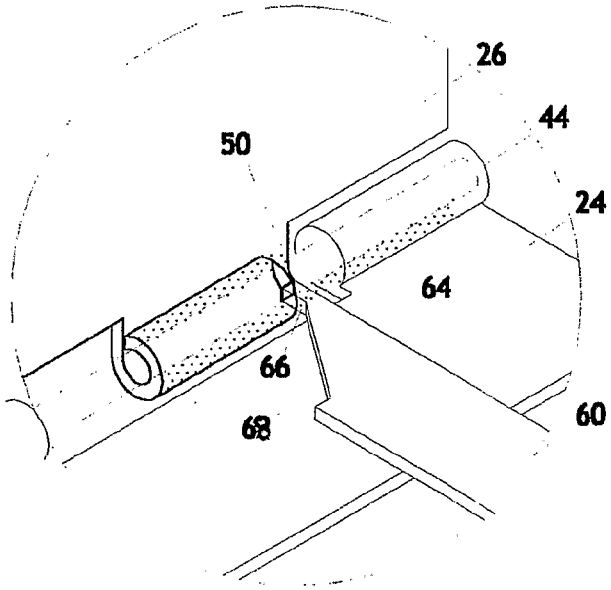
FIG. 15 is a detailed view of the dotted outline area B of FIG. 14.

FIG. 15 shows expanded detail of the outlined area B of FIG. 14. FIG. 15 shows the tapered end 64 of operating rod 60 having a pointed tip 66 and a ramped edge 68. The pointed tip 66, when the bistable spring bracket 22 is in the position shown in FIG. 5B and FIG. 10 is insertable between the pin-retaining sleeve 44 on the first portion 24 and the second position-defining flange 50 on the second member 56. Further insertion of the operating rod 60 causes the second position-defining flange 50 to be urged beyond axial engagement with the first position-defining flange 48 and by action of the ramped edge section 68, and also allows the pointed tip 66 to move the second portion 26 into the position shown in FIGS. 5A, 5C, 5D and FIG. 10. To move from the position shown in FIGS. 2A, 2C, 2D and FIG. 10, the operating rod 60 is moved to engage the rotational edge 56 of the second position-defining flange 50 and cause it to rotate about the pin 42 until it has reached a rotational position which causes axial engagement of the axial edges 58 of the first position-defining flanges 48 and the second position-defining flanges 50 allowing the spring to return the second portion 26 to the position shown in FIGS. 5B and 13. In this manner, the operating rod 60 permits full operation of the bistable spring bracket 22 permitting the bistable spring bracket to be used beneath a locked door, a door which does not need to be opened, a fence or any other item offering an anchorage close to the ground.

The second embodiment of the invention, in its various forms, has hereinbefore been described with reference to a sit-up anchorage 10 and the anchorage has been described as being affixed beneath a door. It is to be appreciated that without the operating rod 60, attachment may be achieved beneath a door which is opened, the bistable spring bracket operated, and then the door closed. The bistable spring bracket 22 can be used to attach any number of styles of items beneath any object which offers a clearance close to the ground. Equally, the apparatus releasably attached can be of any kind.

Figure 16:
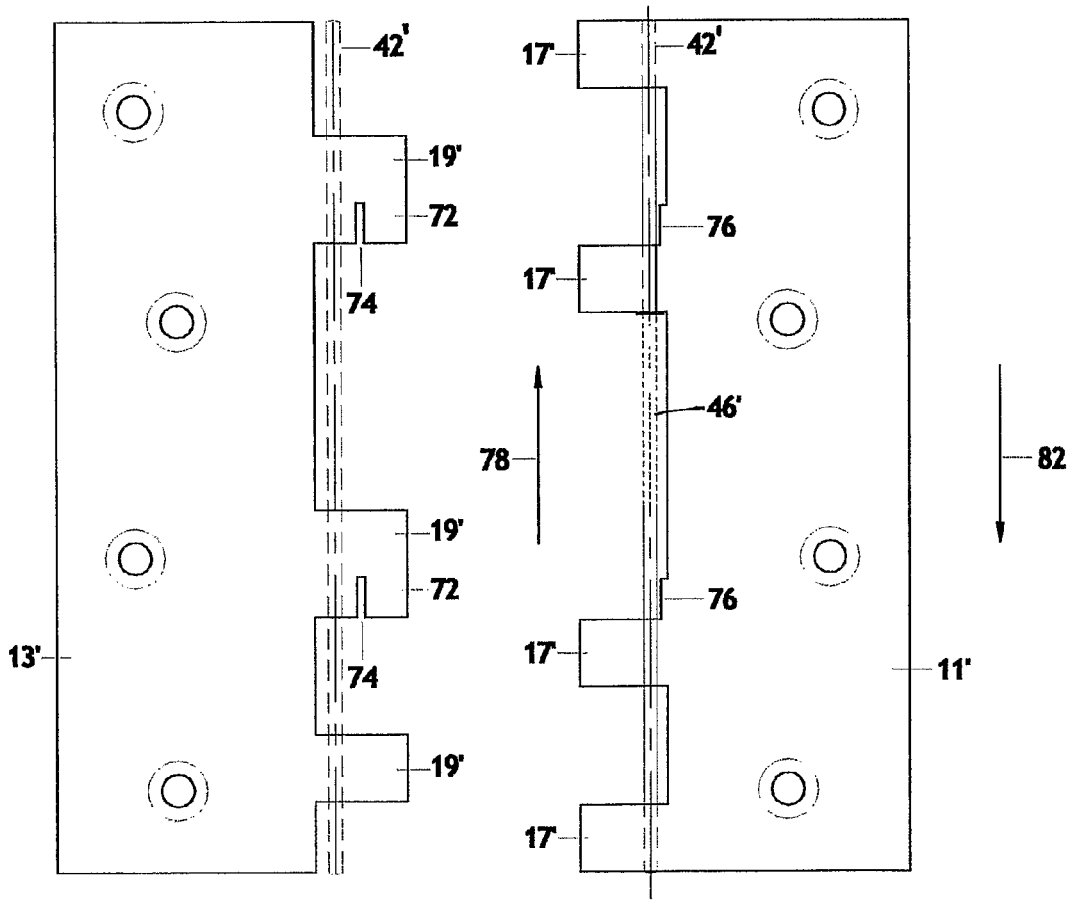
FIG. 16 is a plan view of the flat metal stampings used to form a third embodiment of a hinge, according to the present invention, where the two sides are shown in the stamped condition before they are folded around a pin to form a hinge.

Attention is next drawn to FIG. 16, FIG. 17 and FIG. 18 showing a third embodiment of the present invention in the form of a hinge which is movable to a pre-defined selectable locked angular position.

FIG. 16 shows the third embodiment of the hinge where the two halves have been stamped but not yet folded into the final form. FIG. 17 shows an isometric partially exploded view of the two halves of the hinge of FIG. 16 after they have been folded and a pin and a spring inserted. FIG. 18 shows magnified detail of the boxed portion of FIG. 17.

As with the first embodiment shown in FIG. 1, FIG. 2 and FIG. 3, the hinge comprises a first leaf 11' and a second leaf 13'. The first leaf 11' is attached to the second leaf 13' by means of a pin 42' (shown in dotted outline in the exploded second leaf 13' of FIG. 17) about which first leaf pin-retaining sleeves 17' and second leaf pin-retaining sleeves 19' are wrapped. At least one of the second leaf pin-retaining sleeves 19' comprises a locking extension 72 having a locking slot 74 set therein adapted to receive a locking flange 76 on the first leaf 11' of the hinge. A spring 46' is provided between the first leaf 11' and the second leaf 13' of the hinge to urge the first leaf of the hinge 11' relative to the second leaf of the hinge 13' in an axial direction along the pin 42' as indicated by arrow 78.

From a fully closed position where the first leaf of the hinge 11' is substantially overlapping and parallel to the second leaf of the hinge 13', the first 11' and second 13' leaves are rotated about the axis of the pin 46' as indicated by arrow 80 until the or each locking flange 76 folds on to the or each locking slot 74 at which point the spring 46' urges the first leaf of the hinge 11 in the axial direction as indicated by arrow 78 for the locking slot 76 to be accepted by and held within the locking slot 74 to maintain the hinge at an angle of opening determined by the selected position of the locking slot 74.

When it is desired to release the locking flange 76 from the locking slot 74, the first leaf of the hinge 11' is urged against the spring pressure in an axial direction as indicated by arrow 82 to slide the locking flange 76 out of the locking slot 74. The first leaf of the hinge 11' may then either continue to be rotated as indicated by arrow 80 to open to any position, or can be returned to the closed position.

Though not shown in FIGS. 16, 17 and 18, the hinge can also be provided with position-defining flanges 48, 50 as otherwise shown in FIGS. 2 to 12. Also, more than one set of locking slots 74 can be provided, enabling the hinge to be locked in more than one angular position. Accordingly, the use of opening stops and of locking slots can be combined in one hinge.

Figure 19:
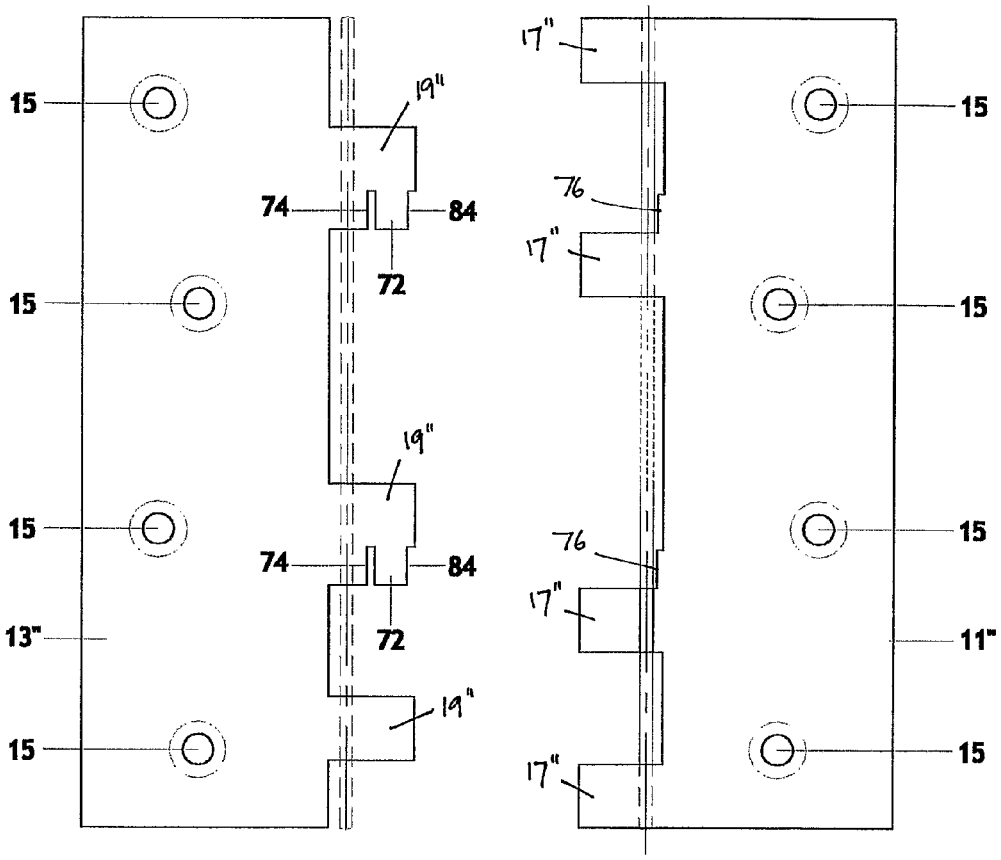
FIG. 19 is a view of the portions of a fourth embodiment of the invention, where the portions are stamped but are not yet folded about the pin and the spring, showing slots in one of the portions providing an intermediate lockable position.

Attention is next drawn to FIG. 19, FIG. 20 and FIG. 21 which together show a fourth embodiment of the present invention where the hinge of FIGS. 16, 17 and 18 is further provided with a means for being kept in a closed and locked position. As with the first embodiment and the third embodiment, the fourth embodiment comprises the hinge having a first leaf of the hinge 11" and a second leaf 13". FIG. 19 shows the two leaves 11", 13" immediately after stamping and before they have been formed into their final shape.

FIG. 20 shows an isometric projected view of the first leaf 11" and the second leaf 13" in a slightly exploded form, in their final formed shapes angularly disposed about a pin. FIG. 21 shows magnified detail of the enclosed area in FIG. 20.

The elements of the fourth embodiment shown in FIGS. 19, 20 and 21 are the same as those of the third embodiment in FIGS. 16, 17 and 18, like numerals indicating like items, with the exception that a notch to form a closed-locking cutaway slot 84 is provided at the distal end of the locking extension 72 on two of the pin-retaining sleeves 19". As shown in FIG. 19, where the second leaf 13" is stamped but not yet formed, the closed-locking cutaway slot 84 provide a cutaway portion of the locking extension 72 the same size and substantially the same width as the locking slot 74. In FIGS. 20 and 21 which show the second leaf 13" in its final shaped form, the sleeve 19" is wrapped around an internal channel for the hinge pin 42' and folded against the substantially planar body of the second leaf 13" to form the closed-locking cutaway slot 84. A locking flange 76 can enter the formed closed-locking cutaway slot 84 when the first leaf 11" and the second leaf 13" are flat against one another as when the door or other item supported by the hinge is closed. The locking flange 76 remains urged into the closing-locking cutaway slot 84 under pressure from the hinge 46". The door remains closed. In order to open the door, the first leaf 11" must be urged as indicated by arrow 82' to clear the locking flange from the closing-locking cutaway slot 84 to allow rotation of the first leaf 11" relative to the second leaf 13" in an angular direction indicated by arrow 80'. The locking flange 76 is urged against the edge 86 of the locking extension 72 to maintain the hinge with the first leaf 11" depressed according to arrow 82' as the first leaf 11" rotates relative to the second leaf 13". If a locking slot 74 is provided, the locking flange 76 can be urged into the locking slot 74 to be retained in a locked angular position as indicated in the description of the third embodiment of FIGS. 16 to 18. If no locking slot 74 is provided the hinge can be fully opened and closed. As soon as the hinge is closed, the pressure of the spring 46" urges the locking flange 76 once more into the closed-locking cutaway slot 84 allowing the first leaf 11" to move axially along the pin 42" as indicated by arrow 78' relative to the second leaf 13" of the hinge to lock the hinge in the closed position.

The embodiments of the invention have shown flanges 25, 27, 48, 50 having rotational 56 and axial 58 edges and locking slots 74, 84 driven by spring 46, 46', 46" pressure. It is to be appreciated that the present invention encompasses one, or any number of the measures shown in the four embodiments to render a hinge lockable, openable to a preselected angular limit, and openable to be retained at one or more selected angular positions.

In particular, the number of locking slots 74 can be increased to provide multiple holding positions for the hinge as it is opened, such a device being of use for the lids of chests, caskets, electronic enclosures and display screens where a predetermined or user selectable angle can be employed.

The invention claimed is:

1. A hinge comprising: a first leaf and a second leaf foldably connected by pin means defining an axis of rotation between the said leaves, each of said first and second leaves having an edge formed with at least two spaced apart aligned pin-retaining sleeves embracing the pin means whereby the said pin means are engaged with each leaf, and the said spaced apart aligned sleeves on each leaf edge are staggered along the pin means, such that a said pin-retaining sleeve of said first leaf is located between two spaced apart pin-retaining sleeves of said second leaf, and a said pin-retaining sleeve of said second leaf is located between two spaced apart pin-retaining sleeves of said first leaf; wherein the first leaf and the second leaf are movable relative to one another along the axis of the pin means by virtue of the spacing between the said spaced apart sleeves being greater than the length of the sleeve therebetween; spring means adapted to bias the respective leaves axially from a first axial position relative to one another on the pin means towards a second axial position relative to one another on the pin means; and abutment means on each said leaf; wherein the said abutment means are provided with abutment surfaces and are so located and dimensioned that (a), when the leaves are in the second axial position, rotational movement of the leaves with respect to one another is limited by a stop formed by the mutual abutment of opposed rotation-limiting abutment surfaces of the respective abutment means, and (b) when the leaves are in the first axial position, against the bias of the spring means, the abutment means on the two leaves are axially displaced so that the respective rotation-limiting surfaces are not opposed and rotational movement of the leaves with respect to one another is not so limited by such stop, and upon rotational movement of the leaves beyond a rotational position corresponding to that of such stop the leaves are freely relatively rotatable while being held in said first axial position by a stop formed by the mutual abutment under the bias of the spring means of opposed axially-directed abutment surfaces of said respective abutment means.

2. A hinge according to claim 1, wherein the abutment means comprise flanges formed in the hinge leaves as integral axial extensions to said pin-retaining sleeves.

3. A hinge according to claim 2, wherein the flanges are operative between adjacent sleeves of the respective hinge leaves.

4. A hinge according to claim 3 wherein the spring means comprise a helical spring around a hinge pin.

5. A hinge according to claim 4 wherein the spring means act between a pin-retaining sleeve on the first leaf and a pin-retaining sleeve on the second leaf.

6. A hinge according to claim 2, wherein the rotation-limiting abutment surfaces of the respective abutment means extend parallel to said axis of rotation.

7. A bistable bracket comprising a hinge according to claim 1 wherein each leaf has, or is attached to, a respective substantially planar portion; said hinge comprising a pin defining an axis of rotation; the first leaf or planar portion having one or more first axial position-defining flanges and two or more first pin-retaining sleeves or channels; the second leaf or planar portion having one or more second axial position-defining flanges and two or more second pin-retaining sleeves or channels; and said spring means providing force along the axis to urge the first and second leaves in a biased axial direction relative to one another; where said first substantially planar portion and said second substantially planar portion are supported by said hinge to rotate about said axis with respect to one another; said first substantially planar portion being rotatable with respect to said second substantially planar portion in a first rotational direction, when urged against the biased axial direction to stress and preferably to compress said spring, to a first angular position to adopt a first axially stable position, where the first and second portions of the bracket are substantially coplanar and said first position-defining flanges are urged into axial abutment with said second position-defining flanges by said spring; and where said second planar portion is rotatable about said axis from said first angular position, in a second rotational direction contrary to said first rotational direction, to a second angular position where said first and second position-defining flanges disengage in the axial direction and said first and second leaves are urged by the spring in the biased axial direction for said second position-defining flanges to axially abut said pin-retaining sleeves or channels in a second axially stable position and for first and second position-defining flanges to mutually abut in said first rotational direction to prevent rotation of said first and second substantially planar portions in said first rotational direction beyond a predetermined angle.

8. A bistable bracket according to claim 7 wherein the first substantially planar portion and the second substantially planar portion are movable relative to one another along the axis of the pin means, said first substantially planar portion comprising a first axial position-defining flange; said second substantially planar portion comprising a second axial position-defining flange; said first substantially planar portion comprising a first rotational position-defining flange; said second substantially planar portion comprising a second rotational position-defining flange; and comprises means to urge the first substantially planar portion in an axial direction towards the second substantially planar portion; where the first substantially planar portion is foldable against the second substantially planar portion and urgeable by the urging means to move relative thereto in the axial direction for said first rotational position-defining flange and said second rotational position-defining flange to engage to maintain the first substantially planar portion and the second substantially planar portion within a limited range of rotational angles from a rotational position in which the leaves are overlying and closed against one another; and where said first substantially planar portion is movable in the axial direction relative to the second substantially planar portion for the first rotational angle defining flange to disengage the second rotational angle defining flange to allow free rotation of said first substantially planar portion about said axis relative to said second substantially planar portion and to be so maintained by said first axial position-defining flange being operable to engage the second axial position-defining flange when said rotational angle is greater than the limited range of angles.

9. A bistable bracket according to claim 8 in combination with an operating rod, operable to urge apart said position-defining flanges and said pin-retaining sleeves and to urge said second side to cause said first and second portion to adopt said first stable position.

10. A bistable bracket in combination with an operating rod according to claim 9 wherein the operating rod is operable to urge apart said pin-retaining sleeves to trigger movement between said first stable position and said second stable position.

11. An exercise device provided with a bistable bracket according to claim 8.

12. A bistable bracket according to claim 7 in combination with an operating rod, operable to urge apart said position-defining flanges and said pin-retaining sleeves and to urge said second side to cause said first and second portion to adopt said first stable position.

13. A bistable bracket in combination with an operating rod according to claim 12 wherein the operating rod is operable to urge apart said pin-retaining sleeves to trigger movement between said first stable position and said second stable position.

14. An exercise device provided with a bistable bracket according to claim 7.

15. A hinge according to claim 1, wherein the abutment means on each leaf are duplicated at two axially spaced-apart locations on the hinge.

16. A hinge comprising: a first leaf; and a second leaf; foldably connected by pin means defining an axis of rotation between the said leaves, each of said first and second leaves having an edge formed with at least two spaced apart aligned pin-retaining sleeves or channels embracing the pin means whereby the said pin means are engaged with each leaf, and the said spaced apart aligned sleeves or channels on each leaf edge are staggered along the pin means, such that a said pin-retaining sleeve or channel of said first leaf is located between two spaced apart pin-retaining sleeves or channels of said second leaf, and a said pin-retaining sleeve or channel of said second leaf is located between two spaced apart pin-retaining sleeves or channels of said first leaf; wherein the first leaf and the second leaf are movable relative to one another along the axis of the pin means by virtue of the spacing between the said spaced apart sleeves or channels being greater than the length of the sleeve or channel therebetween; said first leaf comprising two first axial position-defining flanges; said second leaf comprising two second axial position-defining flanges; said first leaf comprising two first rotational position-defining flanges; said second leaf comprising two second rotational position-defining flanges; and said hinge comprises means to urge the first leaf in an axial direction towards the second leaf; where the first leaf is foldable against the second leaf and urgeable by the urging means to move relative thereto in the axial direction for said first rotational position-defining flanges and said second rotational position-defining flanges on the respective hinge leaves to oppose one another whereby to maintain the first leaf and the second leaf within a limited range of rotational angles from a rotational position in which the leaves are overlying and closed against one another; and where said first leaf is movable in the axial direction relative to the second leaf for the first rotational angle defining flanges to disengage the second rotational angle defining flanges to allow free rotation of said first leaf about said axis relative to said second leaf and to be so maintained by said first axial position-defining flanges being operable to engage the second axial position-defining flanges when said rotational angle is greater than the limited range of angles.

17. A hinge according to claim 16 wherein the limited range of angles issubstantially zero degrees such that the first leaf can be locked in a parallel position closed against the second leaf.

18. A hinge according to claim 16 further comprising at least one axially oriented locking slot engageable with a said flange to provide for at least one releasably interlocking rotational position between the first leaf and the second leaf.

19. A hinge according to claim 16, wherein the said rotational position-defining flanges extend parallel to said axis of rotation.

* * * * *